US007225559B1

(12) United States Patent
Padilla

(10) Patent No.: US 7,225,559 B1
(45) Date of Patent: Jun. 5, 2007

(54) TOOTHBRUSH DRYER

(76) Inventor: Leona Lynn Padilla, 1623 N. Fairmont, Santa Ana, CA (US) 92701

( * ) Notice: Subject to any disclaimer, the term of this patent is extended or adjusted under 35 U.S.C. 154(b) by 0 days.

(21) Appl. No.: 09/312,694

(22) Filed: May 14, 1999

(51) Int. Cl.
*F26B 19/00* (2006.01)

(52) U.S. Cl. ..... 34/202; 34/215; 34/225; 34/239

(58) Field of Classification Search ..... 34/91, 34/202, 215, 225, 239; 219/385, 386, 521
See application file for complete search history.

(56) References Cited

U.S. PATENT DOCUMENTS 3,820,251 A * 6/1974 Abernathy ..... 34/202
4,388,767 A 6/1983 Dison et al.
4,480,394 A 11/1984 Salas
4,625,119 A * 11/1986 Murdock, III ..... 250/455.1
4,733,480 A 3/1988 Hutchins
5,502,900 A 4/1996 Hui
5,620,622 A * 4/1997 Lang ..... 219/385

* cited by examiner

*Primary Examiner*—Pamela Wilson

(57) ABSTRACT

A toothbrush dryer includes a substantially hollow housing having a pair of side walls, a rear wall and an open front in communication with an interior chamber. A door hingedly engages one of the side walls and is pivotable to selectively enclose the interior chamber. The door is retained in a closed position with a magnetic latch assembly. Removably mounted within the interior chamber are a plurality of toothbrush retaining clips. A blower/heater mechanism is mounted within the interior chamber for circulating warm air therethrough. A thermostat deactivates the heater upon the temperature within the interior chamber exceeding a predetermined level.

10 Claims, 2 Drawing Sheets

FIG. 1
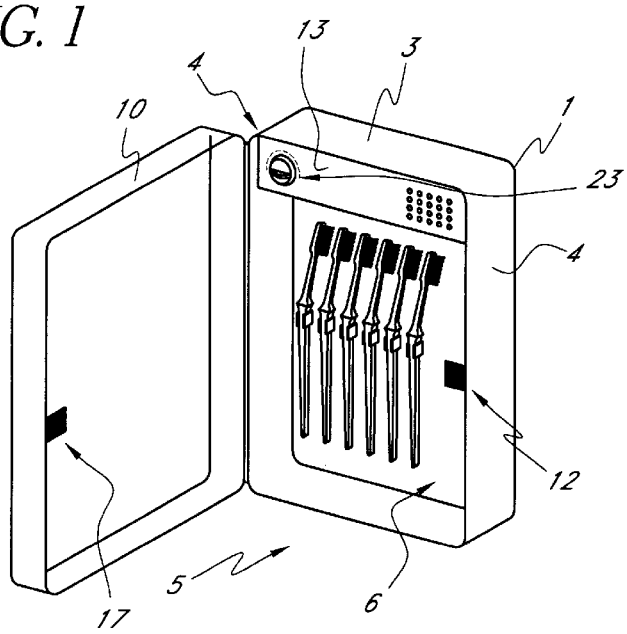
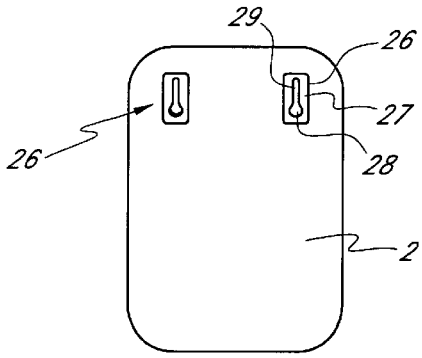
FIG. 2
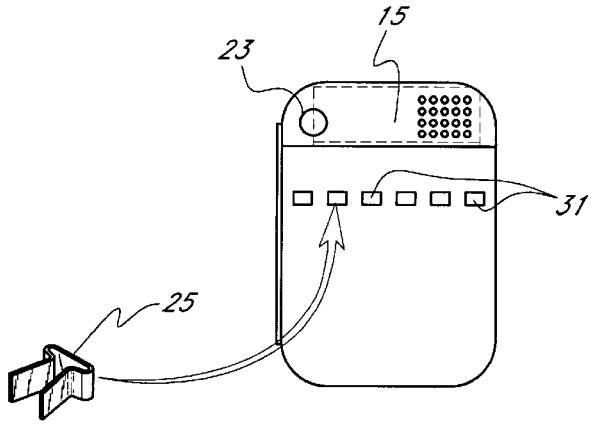
FIG. 3

FIG. 4
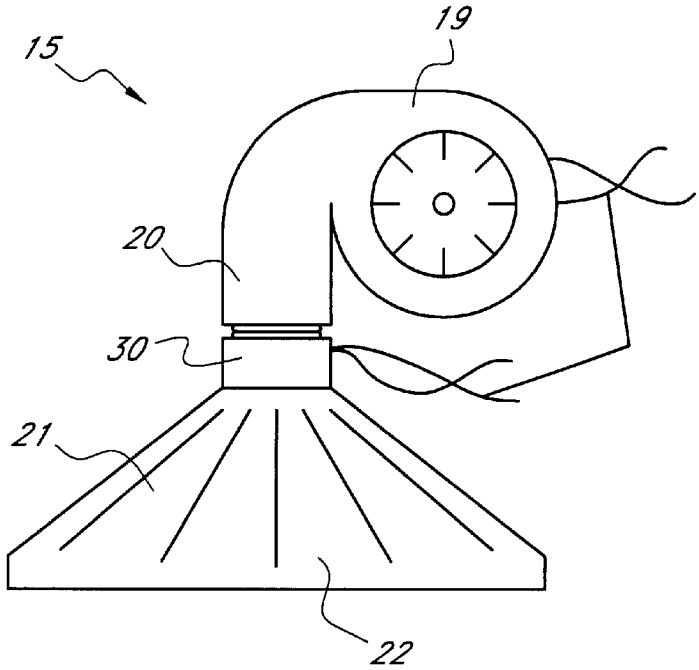
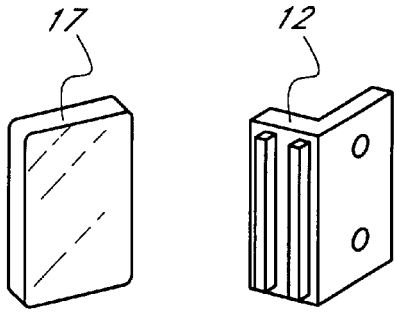
FIG. 5

TOOTHBRUSH DRYER

BACKGROUND OF THE INVENTION

The present invention relates to a toothbrush dryer for storing and drying wet toothbrushes between uses.

DESCRIPTION OF THE PRIOR ART

After each use, a wet toothbrush is typically stored on a countertop or on a toothbrush rack. Wet toothbrushes, however, provide an ideal environment for germ and bacterial growth thereby increasing the potential for transmitting diseases. Accordingly, there is currently a need for a device that is capable of storing and effectively drying wet toothbrushes thereby eliminating the aforementioned problems.

Various toothbrush dryers exist in the prior art. For example, U.S. Pat. No. 3,820,251 issued to Abernathy relates to a toothbrush drying device. The device includes a housing with toothbrush racks, heaters and a fan therein. The interior of the housing is accessible with a top mounted cover.

U.S. Pat. No. 4,388,767 issued to Dison et al relates to a process and apparatus for storing paint brushes and the like. The device includes a housing having antioxidant therein to prevent paint adhering to the brush from hardening.

U.S. Pat. No. 4,480,394 issued to Salas relates to a dryer for a safety razor.

U.S. Pat. No. 4,733,480 issued to Hutchins relates to a dryer for gas masks and the like.

U.S. Pat. No. 5,502,900 issued to Hui relates to a dish dryer.

Although a toothbrush dryer exists in the prior art, as disclosed in Abernathy, supra, the device includes a simple fan/heater assembly that is not designed to evenly distribute warm air across the toothbrushes. Furthermore, the heater assembly is controlled only with a timer which could allow the device to be heated to an undesirable temperature. Finally, the interior of the device is accessible with a removable top-mounted cover requiring a user to reach into the housing interior to remove or add a toothbrush which is cumbersome and inconvenient.

The present invention overcomes the disadvantages of the above described toothbrush dryer by providing a dryer having a uniquely configured heater/blower assembly which assures that warm air is evenly distributed throughout the housing. In addition, the heater is controlled with a thermostat, thereby preventing the temperature within the housing from exceeding a predetermined level. The device also includes toothbrush holding clips that are removable to facilitate cleaning. The housing interior is accessible with a front mounted, pivotable door providing convenient access to the stored toothbrushes.

SUMMARY OF THE INVENTION

The present invention relates to a toothbrush dryer including a hollow housing with an open front that is selectively coverable with a hinged door. The door may be locked in a closed position with a magnetic latch assembly. Removably secured within the interior of the housing are a plurality of toothbrush holders. An upper portion of the housing includes a compartment having a blower/heater mechanism received therein for circulating warm air throughout the interior of the housing. The blower/heater assembly is controlled with both a timer and a thermostat. The rear wall of the housing includes mounting brackets allowing the housing to be conveniently attached to a wall or similar supporting surface. It is therefore an object of the present invention to provide a toothbrush dryer having a uniquely configured heating means that evenly distributes warm air therethrough.

It is another object of the present invention to provide a toothbrush dryer in which the temperature may be selectively controlled.

It is yet another object of the present invention to provide a toothbrush dryer having removable toothbrush holding clips to facilitate cleaning the device. Other objects, features and advantages of the present invention will become readily apparent from the following detailed description of the preferred embodiment when considered with the attached drawings and the appended claims.

BRIEF DESCRIPTION OF THE DRAWINGS

FIG. 1 is a perspective view of the dryer with the front door in an open position.

FIG. 2 is a rear view of the dryer.

FIG. 3 is a front view of the dryer with the drawer in an open position.

FIG. 4 is a detailed view of the heater/blower assembly.

FIG. 5 is a detailed view of the magnetic latch according to the present invention.

DESCRIPTION OF THE PREFERRED EMBODIMENT

Referring now to FIGS. 1 through 5, the present invention relates a toothbrush dryer. The device includes a substantially hollow housing 1 having a rear wall 2, a top wall 3, a pair of opposing side walls 4 and a bottom wall 5. The front is open and is in communication with an interior chamber 6. Hingedly engaging one of the side walls is a door 10 which may be pivoted between an open and a closed position to selectively enclose the interior chamber. An inwardly facing side of the door includes a latch plate 17 preferably constructed with a ferromagnetic material. A magnetic latch 12 is mounted to a side wall of the housing and is positioned to magnetically adhere to the latch plate thereby retaining the door in the closed position.

Within the interior chamber, preferably adjacent the top wall of the housing, is a compartment partially defined by a front panel 13. Received within the compartment is a heater/blower mechanism 15 for circulating warm air throughout the interior chamber. The front panel of the compartment includes an air intake vent 11 for delivering air to the blower assembly. The compartment also includes a lower panel (not pictured) constructed with mesh or an apertured material through which warm air is delivered to the interior chamber.

Referring now to FIG. 4, the blower/heater assembly is depicted in more detail. A blower or fan is received within a casing 19. The blower assembly is what is sometimes referred to as a squirrel cage blower unit. The fan casing includes an outlet 20 that is connected to a heater assembly 30 for heating the air generated by the blower. The heater includes a heating coil connected to a thermostat that disables the heating coil upon the temperature in the housing reaching a predetermined level. Connected to the heater unit is a substantially conical plenum 21, the wider portion 22 of which is open and is disposed immediately adjacent the lower panel of the blower assembly compartment for evenly dispersing warm air throughout the housing interior chamber.

Both the blower and the heating coil are electrically connected to a timer/switch assembly 23 allowing a user to preselect the operating duration of either the heating coil or the blower. In addition, the thermostat will automatically deactivate the heating coil upon the temperature in the interior chamber exceeding a predetermined level. Accordingly, if the temperature within the housing chamber reaches a dangerous level prior to the timer assembly deactivating the fan and/or heater, the heater will be deactivated independently thereof thereby protecting the housing and toothbrushes from overheating.

The interior chamber also includes a plurality of horizontally aligned indentions 31 on the interior surface of the housing rear wall. Each indention receives a toothbrush holding clip 25. Each holding clip is substantially U-shaped and is made from a resilient but slightly flexible material. Therefore, each side of the clip may be compressed to insert the clip into an indention. When the compressed sides of the clips are released, they will expand thereby locking the clips in place. The removable clips facilitate cleaning of the housing interior.

Referring now to FIG. 2, the exterior surface of the housing rear wall includes one or more mounting brackets 26 allowing the housing to be mounted onto a wall or similar supporting surface. Each mounting bracket includes an elongated slot 27 having a circular lower portion 28 and a narrower upper portion 29. Accordingly, the head of a screw or nail embedded within a wall may be inserted into the circular portion with the stem of the nail or screw slidable within the upper portion thereby securing the device to a wall.

The housing is preferably constructed with plastic or a similar equivalent and is preferably insulated to minimize heat loss. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A toothbrush dryer comprising:

a substantially hollow housing having an open front in communication with an interior chamber;

a plurality of toothbrush retaining means received within the interior chamber of said housing;

a blower assembly received within said interior chamber for circulating ambient air therethrough;

a heating assembly disposed immediately adjacent said blower assembly for heating the air being circulated thereby to a predetermined temperature;

a thermostat in communication with said heating assembly for deactivating said heating assembly upon said predetermined temperature being exceeded;

a door hingedly mounted on said housing and movable between an open and closed position to selectively cover said opening and to enclose said interior chamber.

2. A device according to claim 1 further comprising:

a latch plate mounted on an inwardly facing side of said door, said plate constructed with a ferromagnetic material;

a magnetic latch member mounted on said housing and positioned within said opening so as to engage said latch plate when said door is pivoted to a closed position to retain said door in said closed position.

3. A device according to claim 1 wherein said blower assembly further includes an air outlet having a substantially conical plenum secured thereto for evenly distributing air through the interior chamber of the housing.

4. A device according to claim 1 wherein said housing further includes a rear wall having an exterior surface and an interior surface.

5. A device according to claim 4 wherein said toothbrush retaining means each include a clip removably received within an indention on the interior surface of the housing rear wall.

6. A device according to claim 4 further comprising at least one mounting bracket attached to the exterior surface of said housing rear wall for mounting said housing to a supporting surface.

7. A device according to claim 1 further comprising:

a switch means for selectively activating said blower and heating assembly;

a timer means in communication with said switch means for deactivating said blower assembly and heating assembly after a predetermined duration.

8. A toothbrush dryer comprising:

a substantially hollow housing having a rear wall, two side walls and an open front in communication with an interior chamber; said chamber including a segregated compartment;

a plurality of toothbrush retaining clips removably mounted within said interior chamber;

a door hingedly engaging one of said sidewalls to selectively enclose said interior chamber, said door including an inwardly facing side with a ferromagnetic latch plate mounted thereon;

a blower assembly received within said compartment for circulating ambient air to the interior chamber;

a heating means immediately adjacent said blower assembly for heating air being circulated by said blower;

a magnetic latch attached to one of said side walls and positioned within said opening so as to engage said latch plate when said door is pivoted to a closed position.

9. A device according to claim 8 further comprising:

a thermostat electrically connected to said heating means that disables said heating means upon the temperature within said interior chamber exceeding a predetermined level.

10. A device according to claim 8 wherein said rear wall includes an exterior surface having a mounting bracket thereon for mounting said housing to a wall.

* * * * *